US005421759A

United States Patent [19]

Morin

[11] Patent Number: 5,421,759

[45] Date of Patent: Jun. 6, 1995

[54] DYNAMICALLY BALANCED BOUYANT SKIS

[76] Inventor: Robert Morin, 676 Norvège, app. 5, Ste-Foy (Québec), Canada, G1X 3E8

[21] Appl. No.: 190,368

[22] Filed: Feb. 2, 1994

[51] Int. Cl.[6] ..... A63C 15/03

[52] U.S. Cl. ..... 441/077

[58] Field of Search ..... 441/77, 78, 76, 65, 441/68; 114/357, 283

[56] References Cited

U.S. PATENT DOCUMENTS

| | | | |
|---|---|---|---|
| 272,949 | 2/1883 | Freeman . | |
| 1,719,059 | 7/1929 | Krupka et al. | 441/77 |
| 2,696,797 | 12/1954 | Whidden . | |
| 2,873,713 | 2/1959 | Baastrup . | |
| 3,015,830 | 1/1962 | Clark . | |
| 3,027,576 | 4/1962 | Fines . | |
| 3,034,157 | 5/1962 | Abajian . | |
| 3,777,324 | 12/1973 | Jenkins | 441/77 |
| 4,129,912 | 12/1978 | Robinson . | |
| 4,301,562 | 11/1981 | Durr | 441/76 |
| 4,804,345 | 2/1989 | Lee . | |
| 4,915,659 | 4/1990 | Sanders . | |
| 5,080,621 | 1/1992 | Nayes | 441/76 |
| 5,277,636 | 1/1994 | Seith | 441/76 |

FOREIGN PATENT DOCUMENTS

| | | |
|---|---|---|
| 571273 | 2/1933 | Germany . |
| 221057 | 3/1986 | U.S.S.R. . |

*Primary Examiner*—Stephen P. Avila

*Attorney, Agent, or Firm*—Pierre Lespérance; Francois Martineau

[57] ABSTRACT

A pair of buoyant skis are used by a person over a body of water for forward motion thereover by reciprocating motion of the skis in alternate fashion. Each ski is a mirror image of the other and includes an elongated, box-like hull, inwardly lined with buoyant material and defining a water-tight body which is generally right-triangular in cross-section and defines a top deck, a port wall transverse to the top deck and an upwardly inclined starboard wall joining the bottom edge of the port wall with the starboard edge of the top deck. A foot well is formed within the hull body intermediate the bow and stern. The two walls of the hull progressively converge from the stern to the bow. The port wall is straight throughout its length while the starboard wall is longitudinally straight except for a curved bow section which joins both walls. The bottom edge of the port wall forms a longitudinally extending straight keel and additional longitudinal keels protrude from the starboard wall. The two skis do not spread apart during forward motion and produce minimum drag.

7 Claims, 4 Drawing Sheets

DYNAMICALLY BALANCED BOUYANT SKIS

FIELD OF THE INVENTION

This invention relates to the field of floating skis to be worn by a person for support and locomotion over a body of water.

BACKGROUND OF THE INVENTION

Known floating skis to be fitted to the feet of a person for moving over a body of water, have a number of drawbacks. One of these drawbacks is their instability, not only when the skis are stationary, but also during motion, due to the fact that the user's legs tend to spread the skis apart, which impairs forward motion and often causes the skier to fall into the body of water. Moreover, due to the wide contact surface of the ski with the water, relative to the small specific power output generated by the skier, drag is an important factor, and therefore, ski speed over water is typically low.

OBJECT OF THE INVENTION

The main object of the invention is to improve the efficiency of currently existing buoyant skis.

SUMMARY OF THE INVENTION

In accordance with the object of the invention, there is disclosed a pair of buoyant skis to be used by a skier over a body of water for forward displacement thereover by reciprocating motion of the skis in alternate fashion, each ski being a mirror image of the other and comprising:

a) an elongated, box-like hull body with a bow and a stern, said hull body being generally right-triangular in cross-section and defining a top deck, a port wall transverse to said top deck and an upwardly inclined starboard wall, said port wall having a bottom edge which forms a lowermost portion of said hull, said starboard wall joining with said bottom edge, upwardly extending therefrom and joining with the starboard edge of said top deck;

b) a footwell within said hull body intermediate said bow and said stern; and c) buoyant chambers formed in said hull forwardly and rearwardly of said footwell.

Due to their cross-sectional shape the skis are dynamically balanced since the two skis are prevented from laterally moving apart during skiing.

Preferably, each ski includes an aft-to-fore tapering of the hull body, whereby the width of said hull body is smaller at said bow than at said stern thereof. Advantageously, both walls extend from said stern to said bow, said port wall is longitudinally straight throughout its length while said starboard wall is longitudinally straight except for a curved bow section which joins both said walls.

Profitably, each ski includes a downwardly inwardly slanted orientation of said hull body laterally inward side wall, whereby the angular relation between the latter and said top deck is a large acute angle; wherein an inverted V-shape water channel is to be formed between the pair of skis for flow trough passage of water during said reciprocating motion of the skis to reduce drag. Preferably, the starboard wall portion of the footwell outwardly protrudes from the starboard wall such that the footwell will have a sufficient size to accommodate a person's foot in a comfortable way; each ski preferably further includes a few keels, each said keel carried by said starboard wall and projecting outwardly thereof and extending lengthwisely of said elongated hull body; said keels being more specifically directed at dampening any rotation of the ski about its longitudinal axis.

Said top deck is preferably slightly convex in shape, to evenly shed water from both sides. The top mouth of said footwell could also extend upwardly beyond the plane of said hull top deck.

DETAILED DESCRIPTION OF THE DRAWINGS

Figure 1:
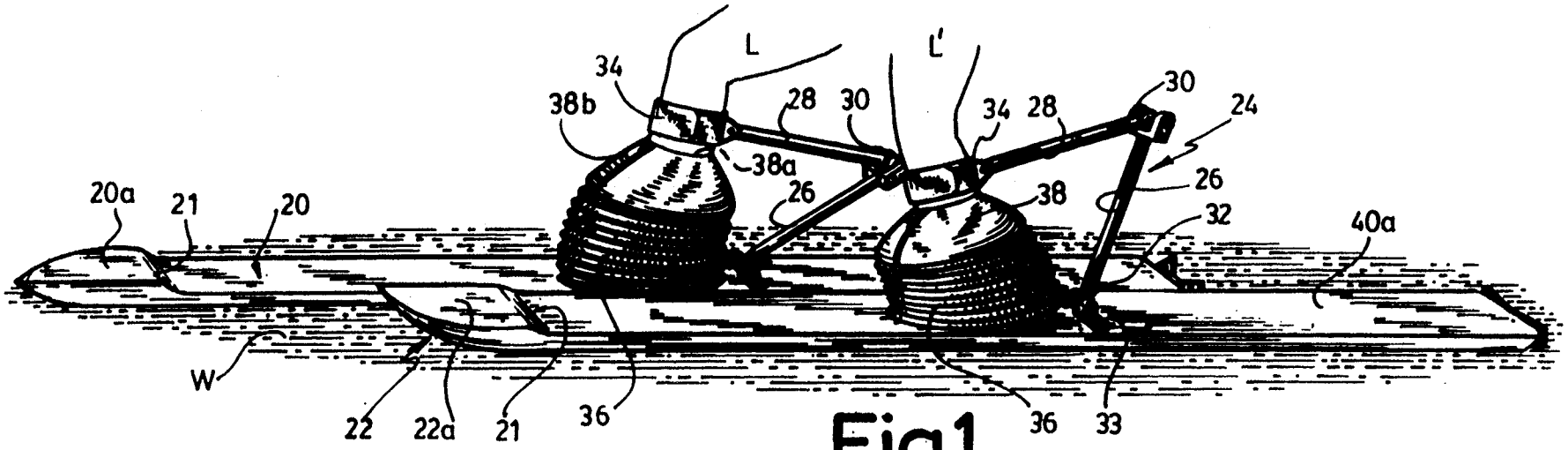
FIG. 1 is a perspective view of a pair of skis floating at the surface of a water body, the silhouette of a person's foot being shown to be operatively engaged into the footwell.

Each ski from the pair of buoyant skis 20, 22, illustrated in FIG. 1 includes an elongated box-like body with conventional tapered bow and untapered stern. An articulation linkage means 24 between the legs L and L' of a person and an intermediate-to-aft end portion of the ski 20 or 22. Linkage means 24 may be of the type generally disclosed in co-pending U.S. patent application Ser. No. 08/136,944 having a receipt date of 18 Oct. 1993, for a Leg support for aquatic skis—thus including two coextensive articulated tie-rods 26 and 28, a first hinge 30 articulating the two rods 26 and 28, a second hinge 32 articulating lower rod 26 to brackets 33 carried aftwardly of the footwell 48 on the deck 40*a* of the ski 20 or 22, and a harness 34 carried at the outer end of upper rod 28 and wound around a corresponding leg L, L'.

Each foot of the skier is enclosed in and concealed by an extensible, accordion-like, tubular skirt 36, this skirt being secured to the deck or top surface 40*a* of the hull 40 of each corresponding buoyant ski member 20 or 22 edgewisely of the footwell mouth 48*a*.

As illustrated in FIG. 1, skirt 36 defines an upper, non pleated, conical section 38 with a diametrally smallest circular top mouth 38*a*. Top skirt mouth 38*a* is destined to conformingly fit around the calf. Foot access to the enclosure formed by skirt 36 is enabled by a slit 38*b* extending lengthwisely of the unpleated conical portion 38, whereby the surface area of mouth 38*a* can be extended by slit 38*b*. Slit 38*b* is long enough to enable free passage of a foot through slit and coextensive mouth 38*a*. When the skier's foot F has been engaged into footwell 48 within the ski hull 40, the skirt 36 is closed against the calf of leg L (L') by engaging a closure member (not illustrated), e.g. a watertight sealing band, or a hook and loop fastener (e.g. VELCRO, a registered trademark), again with a watertight sealing band, or the like devices known to those skilled in the art. The two meeting slit edge portions of the conical unpleated skirt portion 38 can be made to overlap one another, to adjust in watertight fashion against the smaller calf of skinnier persons.

Skirt 36 is made from a watertight, flexible, elastomeric material, so as to keep the skier's feet substantially dry or at least warm during movement over the body of water W.

Figure 3:
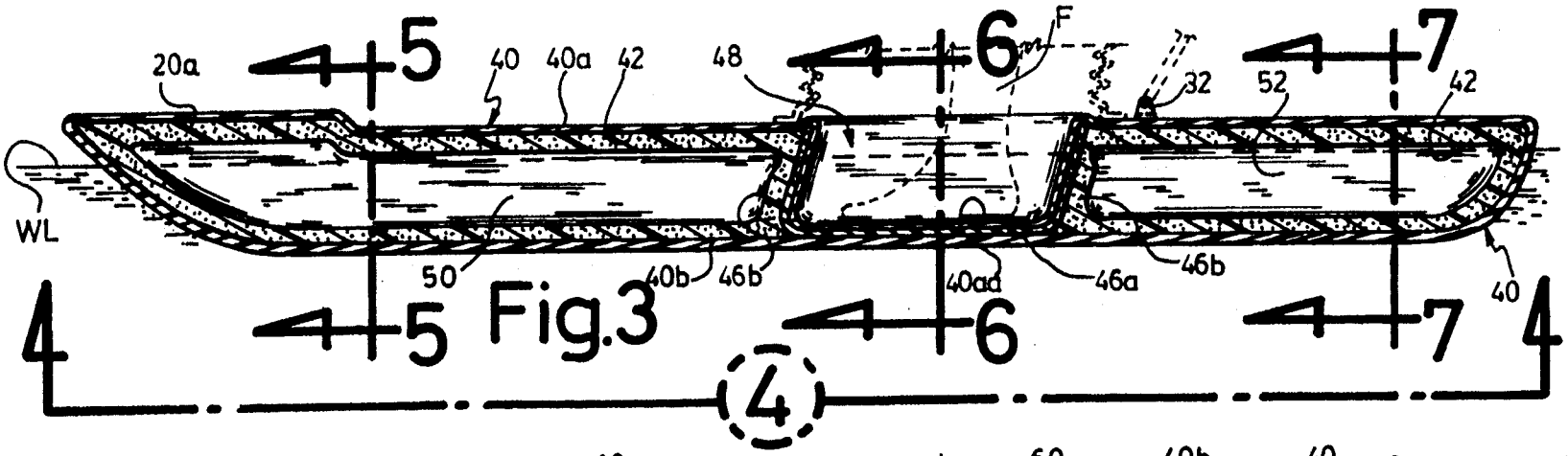
FIG. 3 is a vertical sectional view of the buoyant skis, along lines 3—3 of either of FIGS. 2 or 2*a*.

As illustrated in FIG. 3, each buoyant ski consists of a relatively rigid external hull, 40, with a buoyant foam layer 42 being carried against most of the interior face of the hull. An intermediate foot well 48 is formed by a cross-sectionally U-shape basin 46, made from a relatively rigid material, preferably the same as the hull 40. The flat base wall **46*a* of basin 46 sits directly against the registering floor section 60 of the hull (no layer of buoyant material therebetween), while the side walls thereof, at 46*b*, extend upwardly to the main level of the hull deck 40*a*. Deck 40*a* includes an intermediate section, 40*aa*, which is deformed to engage into the hollow of the ski and to conformingly fit against the interior faces of the basin side walls 46*b* and against the basin base wall 46*a*. Therefore, deck invagination 40*aa* defines a footwell 48, with a top mouth 48*a* at the level of or slightly upwardly offset from the deck 40*a***.

Hence, as suggested in FIG. 3, a front chamber 50 and a rear chamber 52 are defined, being spaced by the registering pairs of basin side walls **46*b*. Each chamber 50, 52, is lined on its interior face by the foam layer 42—including the external faces of the two fore and aft side walls 46*b* of the basin 46 which carry an upturned (substantially vertical) layer of foam, whereby chambers 50 and 52 are substantially watertight (no water from the exterior water body W should be allowed thereinto, since this would undesirably increase the water displacement of the skis. In each chamber 50, 52, foam layer 42 is relatively thin so that most of the interior volume of each such chamber is hollow. The hollowness of chambers 50, 52**, provides lightweightness to the ski construction, without compromising on the buoyancy thereof.

Figure 2:
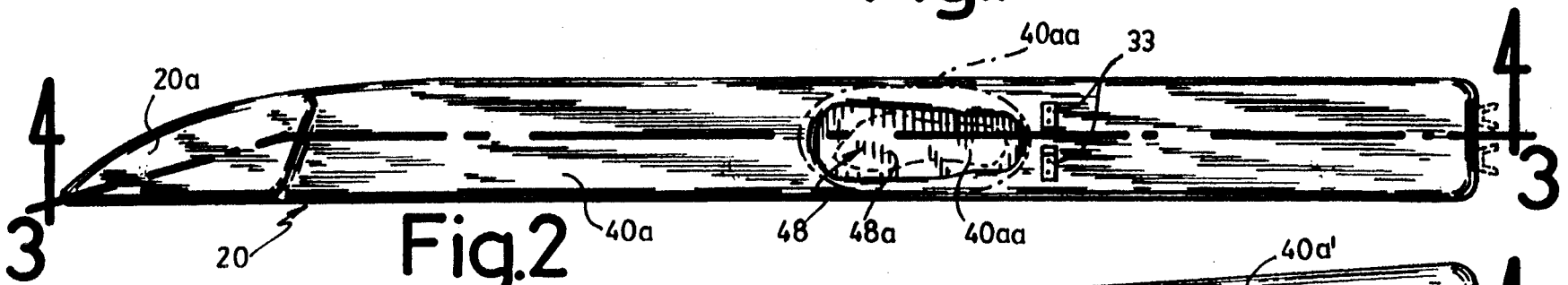
FIGS. 2 and 2*a* are top plan views of two different embodiments of buoyant skis according to the invention.

As suggested in FIGS. 2 and **2*a*, the footwell 48 receive the foot of a water-skier. Preferably, the top mouth 48*a* of the footwell 48** defines a surface area which is longer and wider than a foot F, to more particularly enable free engagement and back and forth inclination of a skier's leg L therethrough.

Figure 4:
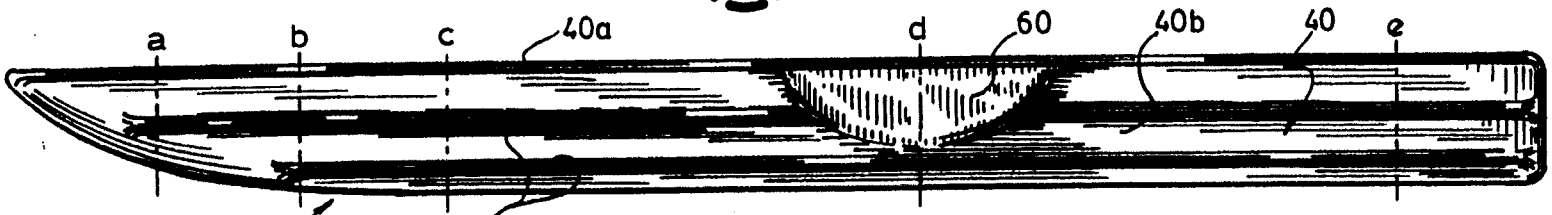
FIGS. 4 and 4*a* are bottom plan views of the two embodiments of buoyant ski from FIGS. 2 and 2*a*, respectively, as taken from perspective 4 in FIG. 3.
Figure 4A:
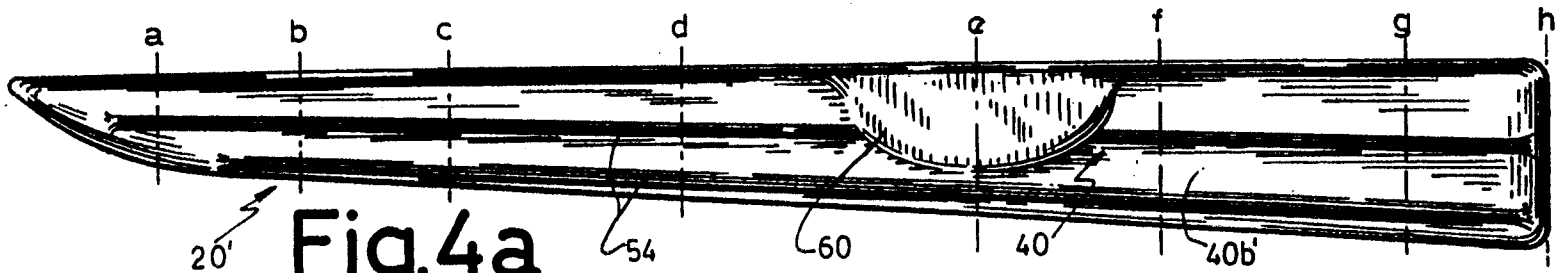

Preferably, the deck **40*a* is raised at the bow portion 20*a*, 22*a*, of each ski 20, 22, wherein a step 21 is defined in the deck 40*a*. Also, a few spaced projecting keels 54 (FIGS. 4, 4*a*) can be added lengthwisely of the exterior face of hull 40**.

Figure 5:
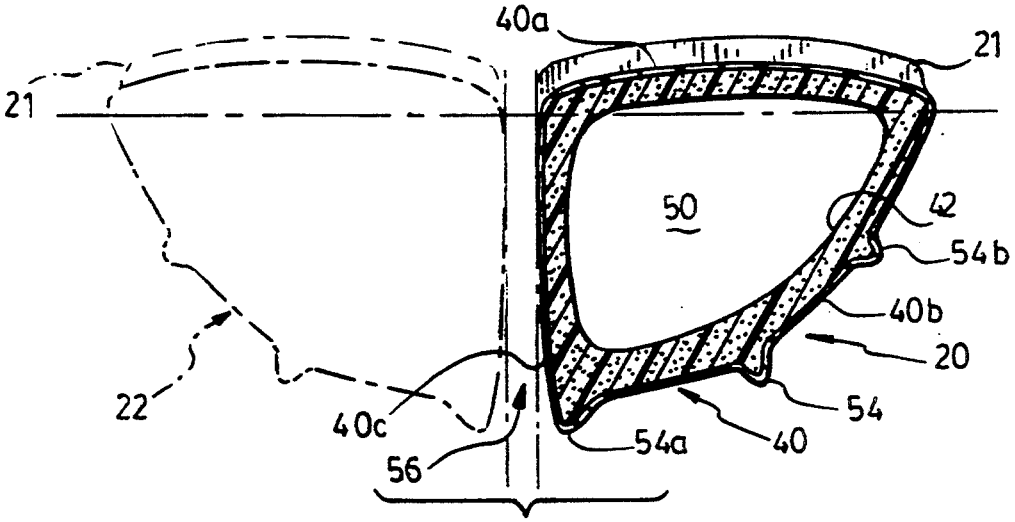
FIGS. 5, 6 and 7 are cross-sectional views at an enlarged scale of the first embodiment of the buoyant ski, taken along lines 5—5, 6—6 and 7—7 respectively of FIG. 3.
Figure 6:
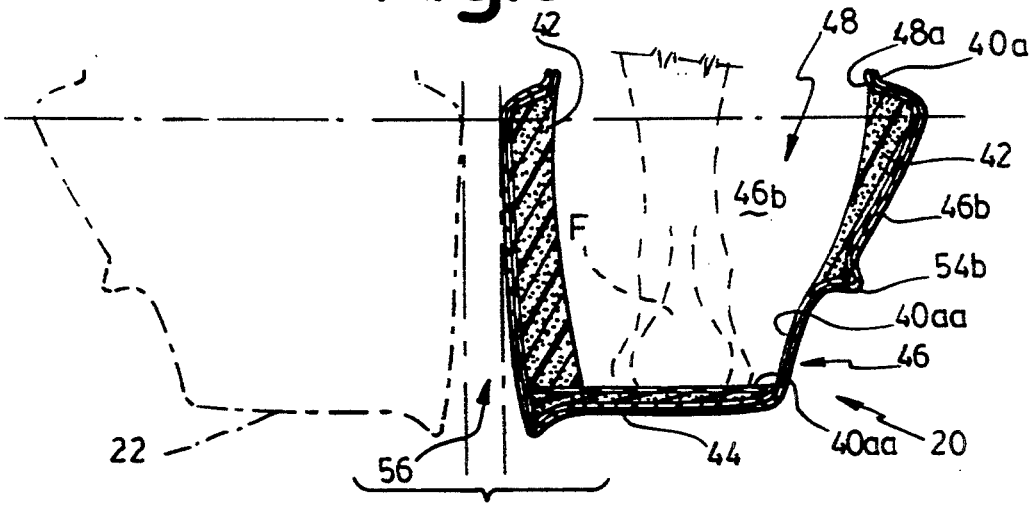
Figure 7:
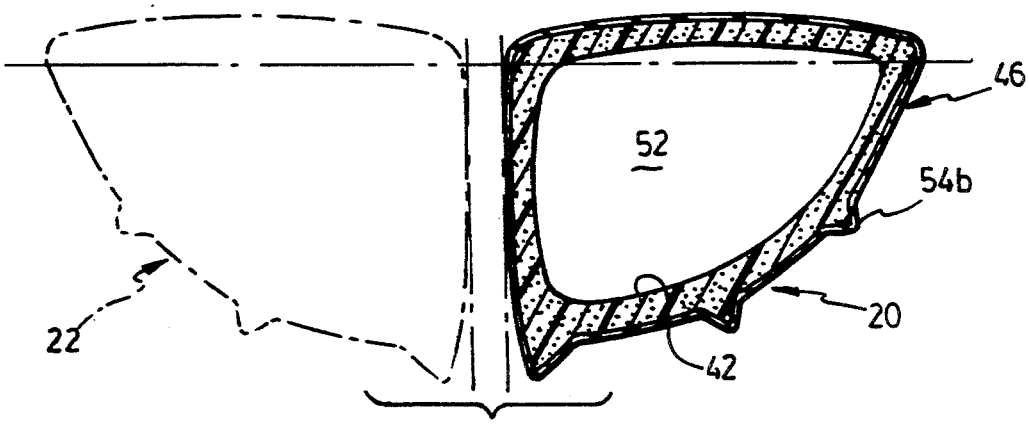

As suggested in FIGS. 5, 6 and 7, hull 40 is generally right triangular in cross-section, defining the top deck **40*a*, a starboard wall 40*b*, and a port wall 40*c*. Port wall 40*c* is transverse to deck 40*a* while starboard wall 40*b* is upwardly inclined, extends from the bottom edge 54*a* of port wall 40*c* and merges with the starboard edge of deck 40*a*. Edge 54*a* forms the lowermost position of hull 40. Therefore, during skiing, the up and down displacement of each ski results in laterally outward displacement of the water and the reaction force keeps the ski close to the other, counterreacting the laterally outward force exerted by the skier's leg on the ski A. Starboard wall 40*b* is preferably generally convex and provided with outwardly protruding keels 54, 54*b*. Bottom edge 54*a* also forms a keel which outwardly protrudes from starboard wall 40*b*. The spaced hull keels 54, 54*a* and 54*b* extend longitudinally of the hull and about both vertically spaced horizontal planes and horizontally offset vertical planes. Such obliquely staggered spatial keel arrangement is designed to provide enhanced stationary stability of the water skis when on water. Moreover, part wall 40*c* of the hull 40 is preferably not exactly vertical in the stable floating condition of the ski, but rather, is downwardly outwardly slanted. As clearly apparent from FIGS. 5, 6 and 7, this means that the horizontal gap between the pair of skis 20, 22 is smaller at the upper deck 40*a* than at lowermost keel 54*a* of the hull 40. An inverted V-shape water channel 56 is formed by the port walls 40*c* of the floating skis 20, 22, all along their length. Such V-shape water channel 56 prevents direct contact of the two inner side walls 40*c*** over a large area and therefore decreases wear of the surface of these walls.

Figure 2A:
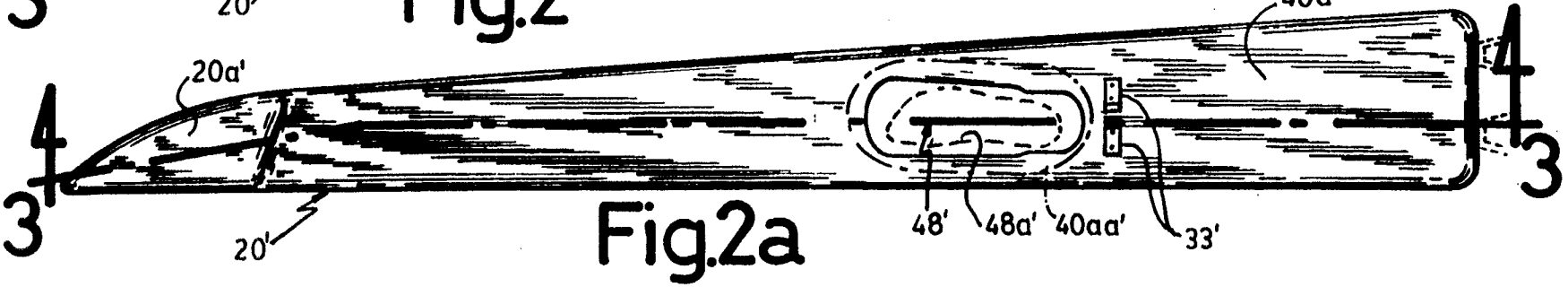
Figure 5A:
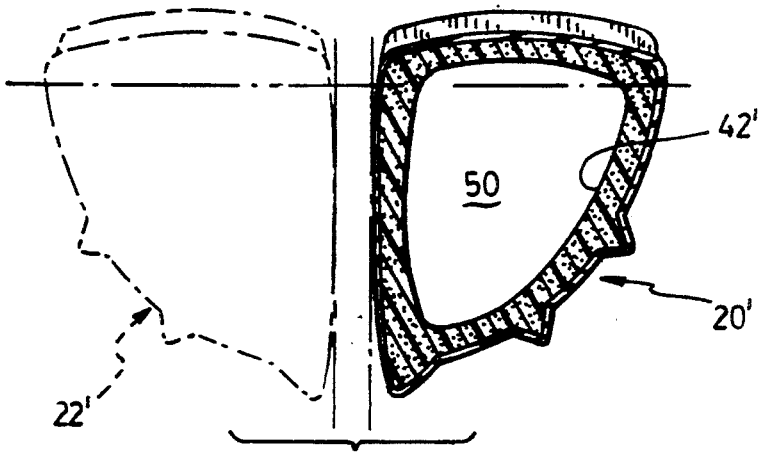
FIGS. 5*a*, 6*a* and 7*a* are views similar to FIGS. 5, 6 and 7 respectively, but for the second embodiment of FIG. 4*a*.
Figure 6A:
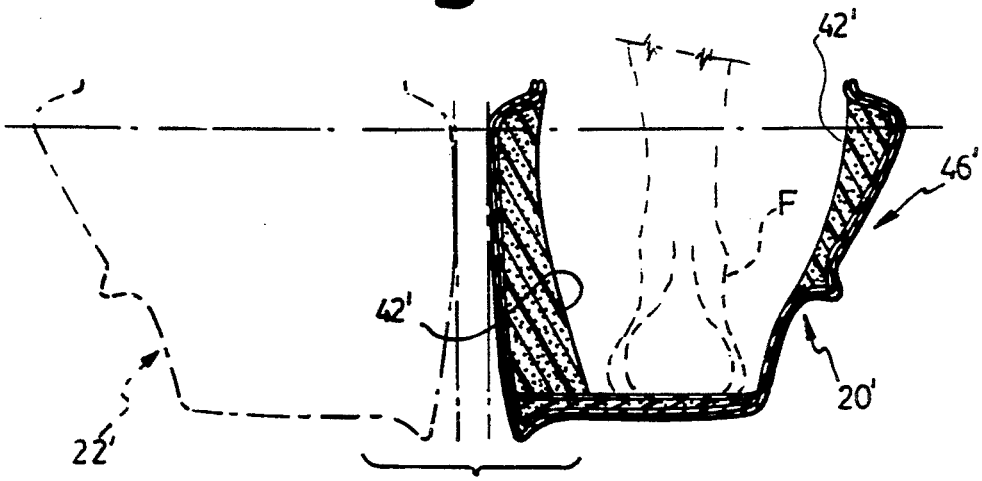
Figure 7A:
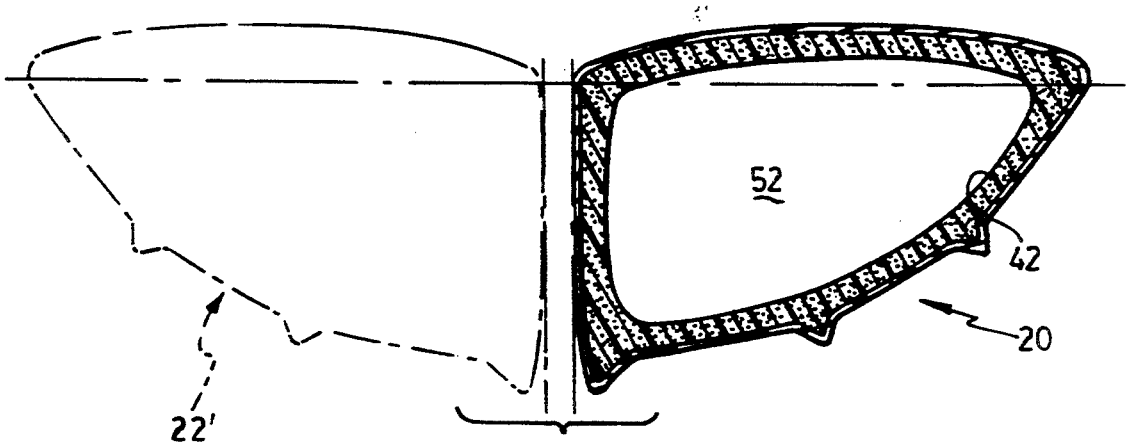

In the embodiment of ski 20 illustrated in FIG. 2, the bow and aft portions of the ski are of substantially constant cross-section, as suggested by FIGS. 5 and 7 respectively. In the alternate embodiment of ski 20' illustrated in FIG. **2*a*, the bow portion is of substantially smaller cross-section than the aft portion of the hull, as suggested by FIGS. 5*a* and 7*a*, respectively; such differential cross-section being designed to provide an improved hydrodynamic ski shape, since the forward tapering of each ski hull means less drag during forward motion. In both embodiments, the port wall 40*c* is longitudinally straight throughout its length while the starboard wall 40*b* is longitudinally straight except for a curved bow section 20*a*, 20*a'* which joins both walls. In the second embodiment shown in FIG. 2*a*, the two walls 40*b* and 40*c* progressively converge from the stern to the bow of the hull 40**.

As suggested in FIGS. **4, 4*a* and 6–6*a*, intermediate footwell 48 outwardly protrudes from the starboard wall 40*b*, to accommodate the large volume required for receiving the person's foot F. This is done by vertically upwardly extending the walls 40*aa* from semi-circular floor section 60. The interior face of footwell 48 is also lined with a layer of buoyant foam material 42**.

In operation, the person wears shoes which are attached at the front by a ski binding similar to that used for cross-country skiing on snow. The person or skier moves forwardly over water with skis 20, 22, through reciprocating motion of the skis in alternating fashion, while maintaining his lateral balance by the linkage arm assembly 24. The keels **54, 54*a*, 54*b*** substantially prevent laterally outwardly downwardly directed tilt of the skis, due to the laterally stabilizing effect of axial water flow along the keels.

As the person stops to reciprocate back and forth his skis in alternate fashion, the forward motion of the skis decreases (some coasting over water does continue for a while), until drag completely stops the skis over water. At that point, the likelihood of axial rotation of the skis would increase, but since keels **54, 54*a*, 54*b*** extend axially of the skis, they in effect constitute brakes that dampen any tendency of lateral rotational torque of the skis that could be borne by random leg motion of the person.

I claim:

1. A pair of buoyant skis to be used by a skier over a body of water for forward displacement thereover by reciprocating motion of the skis in alternate fashion, each ski being a mirror image of the other and comprising:

a) an elongated, box-like hull body with a bow and a stern, said hull body being generally right-triangular in cross-section and defining a top deck, a port wall transverse to said top deck and an upwardly inclined starboard wall, said port wall having a bottom edge which forms a lowermost portion of said hull, said starboard wall joining with said bottom edge, upwardly extending therefrom and joining with the starboard edge of said top deck;

b) a footwell within said hull body intermediate said bow and said stern; and c) buoyant chambers formed in said hull body forwardly and rearwardly of said footwell.

2. A pair of skis as defined in claim 1, wherein both said walls extend from said stern to said bow and said port wall is longitudinally straight throughout its length while said starboard wall is longitudinally straight except for a curved bow section which joins both said walls.

3. A pair of buoyant skis as defined in claim 2, wherein said starboard wall converge towards said port wall from said stern to said bow.

4. A pair of buoyant skis as defined in claim 1, wherein said starboard wall has a generally convex shape and said footwell has a starboard wall portion which outwardly protrudes from said starboard wall and wherein each ski further includes spaced keels longitudinally extending along said hull and outwardly protruding from said starboard wall.

5. A pair of buoyant skis as claimed in claim 4, wherein said bottom edge of said port wall outwardly protrudes from said starboard wall and forms a bottom keel extending longitudinally of said hull body.

6. A pair of buoyant skis as defined in claim 1, wherein said top deck is lightly convex transversely of said hull.

7. A pair of buoyant skis as defined in claim 1, wherein said footwell has a top mouth which upwardly protrudes from said top deck and which surrounds said footwell.

* * * * *

UNITED STATES PATENT AND TRADEMARK OFFICE

CERTIFICATE OF CORRECTION

PATENT NO. : 5,421,759

DATED : June 6, 1995

INVENTOR(S) : Robert Morin

It is certified that error appears in the above-indentified patent and that said Letters Patent is hereby corrected as shown below:

On the title page, item [54], "Dynamically Balanced Bouyant Skis" should read -- Dynamically Balanced Buoyant Skis--.

Signed and Sealed this

Twenty-ninth Day of August, 1995

*Attest:*

Bruce Lehman

BRUCE LEHMAN

*Attesting Officer*

*Commissioner of Patents and Trademarks*